US006338354B1

(12) United States Patent
Alexander

(10) Patent No.: US 6,338,354 B1
(45) Date of Patent: Jan. 15, 2002

(54) COLLAPSIBLE POWER GAIT WALKER

(76) Inventor: Larry Rush Alexander, 2306 Central St., Evanston, IL (US) 60201

( * ) Notice: Subject to any disclaimer, the term of this patent is extended or adjusted under 35 U.S.C. 154(b) by 0 days.

(21) Appl. No.: 09/502,755

(22) Filed: Feb. 11, 2000

(51) Int. Cl.[7] ..... A61H 3/00
(52) U.S. Cl. ..... 135/67; 135/84
(58) Field of Search ..... 135/65–67, 74, 135/76, 77, 82, 84, 86, 72

(56) References Cited

U.S. PATENT DOCUMENTS

| | | | | | |
|---|---|---|---|---|---|
| 3,945,389 | A | | 3/1976 | Smith | |
| 3,993,088 | A | | 11/1976 | Thomas | |
| 4,162,101 | A | | 7/1979 | McCague, Sr. et al. | |
| 4,248,256 | A | * | 2/1981 | Thomas | 135/67 |
| 4,342,465 | A | | 8/1982 | Stillings | |
| 4,452,484 | A | | 6/1984 | Pastor | |
| 4,461,471 | A | | 7/1984 | Brastow | |
| 4,481,965 | A | | 11/1984 | Watkins | |
| 4,621,804 | A | | 11/1986 | Mueller | |
| 4,748,994 | A | | 6/1988 | Schultz et al. | |
| 4,922,940 | A | | 5/1990 | Lewy | |
| 5,083,806 | A | | 1/1992 | Brown | |
| 5,217,419 | A | | 6/1993 | Harwood | |
| 5,271,422 | A | | 12/1993 | Sorrell et al. | |
| 5,499,856 | A | | 3/1996 | Sorrell et al. | |
| 5,509,152 | A | * | 4/1996 | Kippes | 135/67 |
| 5,579,793 | A | * | 12/1996 | Gajewski | 135/67 |
| 5,605,169 | A | | 2/1997 | Light | |
| 5,741,020 | A | | 4/1998 | Harroun | |
| 5,785,070 | A | * | 7/1998 | Block | 135/67 |
| 5,853,219 | A | | 12/1998 | Santuccio | |
| 5,862,825 | A | * | 1/1999 | Leonard | 135/67 |
| 5,979,476 | A | * | 11/1999 | Cranny | 135/67 |
| 6,145,524 | A | * | 11/2000 | Li | 135/67 |

* cited by examiner

*Primary Examiner*—Beth A. Stephan
(74) *Attorney, Agent, or Firm*—McAndrews, Held & Malloy, Ltd.

(57) ABSTRACT

An orthopedic walker having a rear crossbar which is pivotally mounted to two side frames allowing for sequential movement of one side frame forward relative to the other to facilitate walking. A pair of wrist guards are positioned at the top of each frame and the frames provide a smooth transitioning of a number of handholds to aid in standing from a seated position.

10 Claims, 4 Drawing Sheets

COLLAPSIBLE POWER GAIT WALKER

BACKGROUND OF THE INVENTION

The invention relates to a collapsible orthopedic walker, and more particularly to a rear crossbar articulated walker.

Traditional walkers have enabled people with reduced use of their legs to walk. However, there are features of these traditional walkers that are not optimal.

For example, the front crossbar design of a traditional walker greatly reduces the length of a person's gait. The gait is the measured distance covered by a person in one or more steps. While a user may have a reduced gait already due to an injury or affliction, the user never has the opportunity to graduate to full gait length with a traditional walker.

In addition, the single-button collapsible feature of the traditional walker is not ideal. The purpose of the single-button feature is to allow the user to simply press one button to collapse the walker. Both legs then fold inwardly, to create a spatially reduced structure that can be stored in the back of a car, restaurant, movie theater, etc. A common complaint regarding single-button collapsibility is the fact that both legs must be collapsed and not one only. This hinders users from being able to collapse a single side leg to navigate through a narrow doorway, for example.

In addition, a traditional walker does not have a standing aid. Without an aid, a user finds it difficult, and sometimes impossible, to get up from a seated position without the help of an outside source. This is particularly awkward in a more private atmosphere, such as a restroom.

In addition, the ergonomics of traditional walkers are not optimal. There is a need for a better interface between the handles of the walker and the user's hands.

In view of these problems, some improvements have been made by others to the traditional walker. For example, the walker has been modified to provide a standing aid. A "stair-step" approach has been added to the handgrip area in order to provide a lower handgrip disposed subjacent to the standard handgrip. This two-step approach allows the user to "march" up, one handle grip at a time, in order to rise to a standing position. However, this requires increased upper-body strength for the user to be able to maneuver himself to a standing position.

Therefore, it is an object of the present invention to provide an improved light-weight stable walker.

It is yet another object of the present invention to provide a walker with a standing aid to permit a user to easily stand from a sitting position.

It is yet another object of the present invention to provide a walker that will facilitate toilet use.

It is another object to provide a walker that may be used both indoors and outdoors.

It is another object of the present invention to provide a collapsible walker for storage and travel.

It is another object of the present invention to provide a walker that can be partially collapsed to help the user safely navigate through a narrow doorway.

It is another object of the present invention to provide a walker for people who need a transition between a wheel-chair and walking.

It is another object of the present invention to provide a walker without a front crossbar.

SUMMARY OF THE INVENTION

These and other objects of the invention are achieved in a walker having a pair of side frame members and a rear crossbar member. The crossbar member is pivotally mounted for independent movement relative to each of the side members.

DETAILED DESCRIPTION OF THE PREFERRED EMBODIMENT

Figure 1:
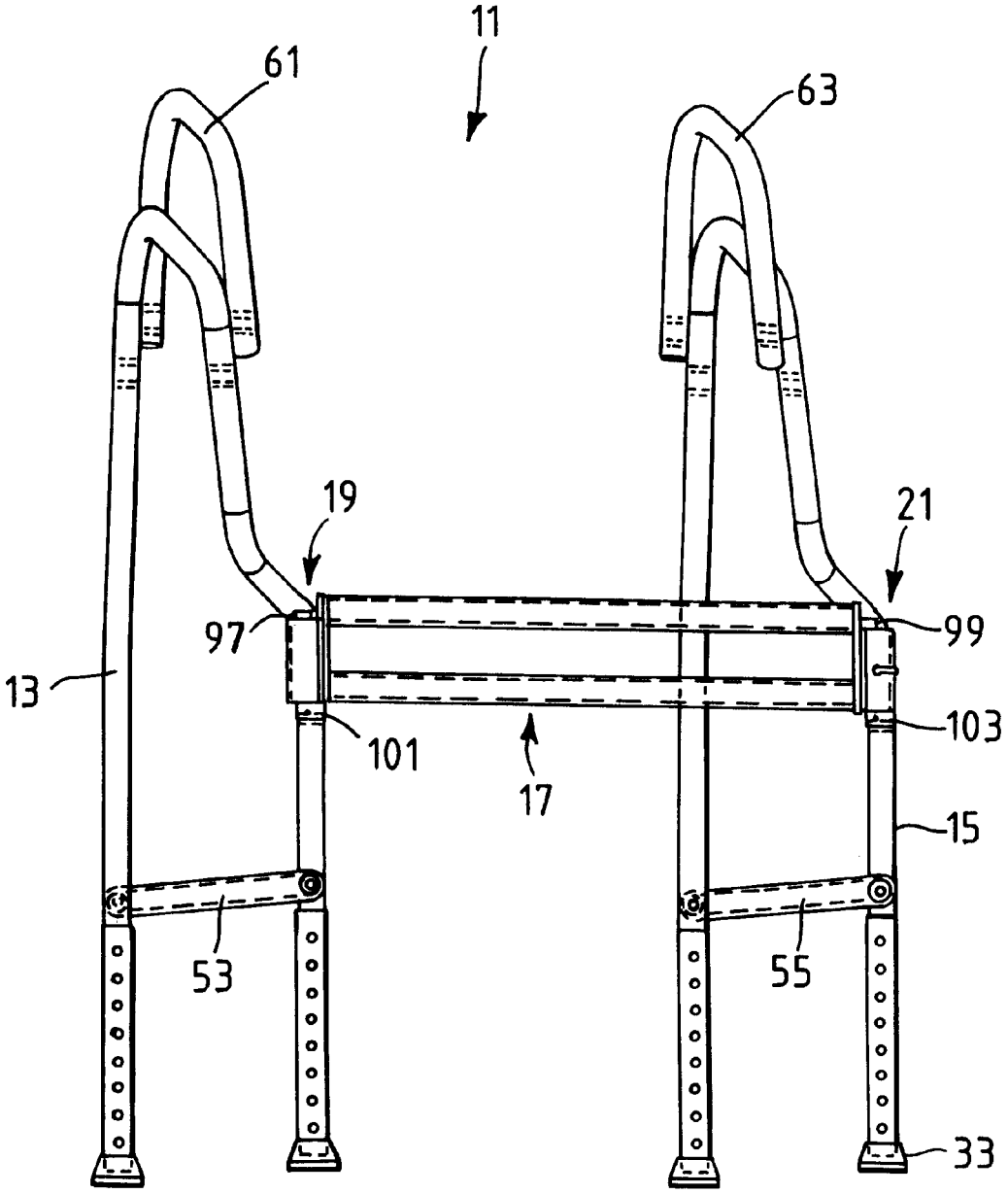
FIG. 1 is a perspective view of a walker according to the present invention.

Referring to FIG. 1, a walker 11 is constructed from a left side frame 13, a right side frame 15 and a rear crossbar 17. Crossbar 17 has one end 19 pivotally connected to left side frame 13 and another end 21 pivotally connected to right side frame 15. Side frames 13, 15 are generally identical (mirror images), as shown.

Figure 2:
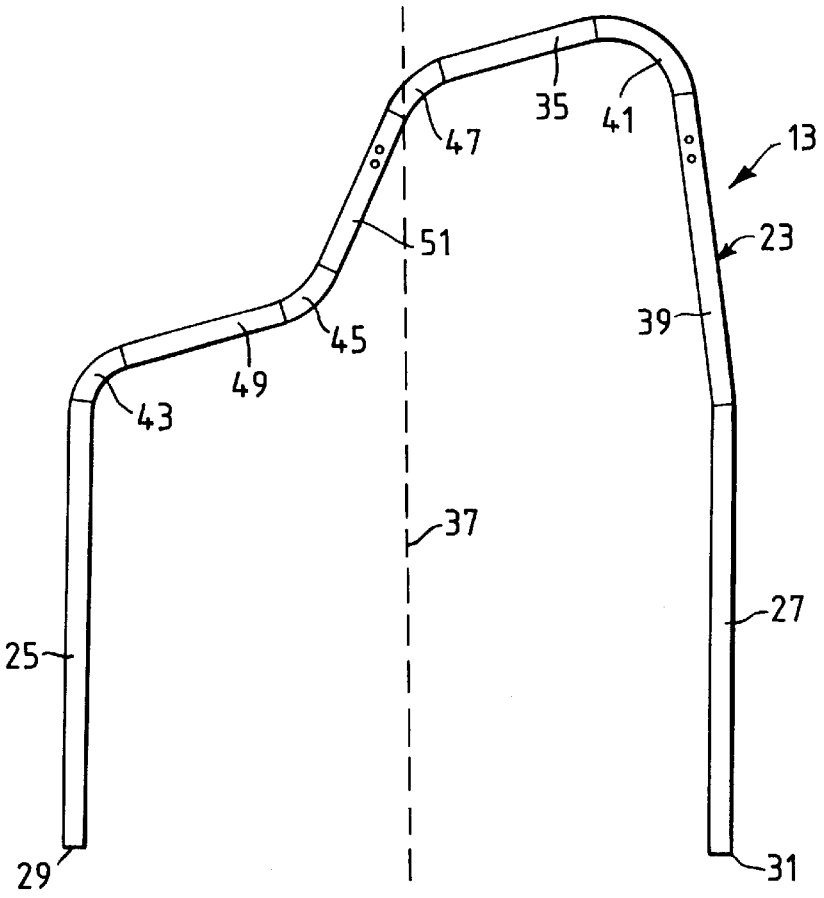
FIG. 2 is a side view of the left side frame of the walker of FIG. 1.
Figure 3:
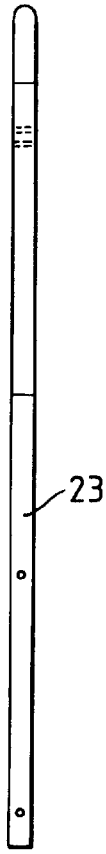
FIG. 3 is an end view of the left side frame of FIG. 2.

Referring to FIGS. 2 and 3, left side frame 13 is formed from a hollow light-weight cylindrical tube 23 which is bent to the shape shown in FIG. 2. Bending may begin with the backside of the frame working forward. Tube 23 also may be cut and plugged together in a conventional manner to facilitate bending.

Frame 13 is preferably planar, lying within the planes defined by the outside and inside surfaces of tube 23, as shown in FIG. 3. The preferred tube 23 is made from aluminum or other metal alloys or plastics, for example, to be lightweight and has an outside diameter of one inch.

Frame 13 includes a linear rear leg portion 25 and a linear front leg portion 27. Each leg portion 25, 27 terminates in a respective support end 29, 31. End 31 provides a flat surface for making supporting contact with the floor during a walking maneuver of walker 11. End 29 preferably provides a convex curvilinear surface for making supporting contact with the floor, in a rocking-type motion similar to a rocking chair, for ease of forward advancement during a walking maneuver. As will suggest itself, ends 29, 31 may be capped with a rubber tip or cup 33 (FIG. 1) to provide a non-slip surface. The curvilinear surface of end 29 may be achieved through shaping either the end 29, the cup 33 or both. Leg portions 25, 27 are twenty (20) inches in length and are spaced apart in a substantially parallel relationship by a distance of twenty-nine (29) inches center to center.

A main hand grip portion 35 is a linear section of the tube 23, approximately 7.28 inches long. Portion 35 is located forward, to the front, of the centerline 37 of the frame, and disposed at an acute angle with the floor (or horizontal).

Hand grip portion 35 is supported by a linear section 39 and a curved section 41 of tube 23 connected between front leg portion 27 and hand grip portion 35. Three curved sections 43, 45, 47 and two linear sections 49, 51 are connected between rear leg portion 25 and hand grip portion 35. As will suggest itself other shapes of tube 23 may be used to dispose grip portion 35 relative to leg portions 25, 27.

The sections 43, 45, 49, 51 provide a smooth upwardly increasing section of tube 23 to provide a plurality of hand holding areas or handles to permit the user to get up from a seated position. Linear sections 49 of the two frames provide a set of low handles or handholds where the user may grip the walker initially when seating himself in order to lower himself or herself onto a seat or a toilet. In performing this seating maneuver, the user, while standing, merely moves or slides his or her hands down to handles 49. Once the user's hands are in place on handles 49, the user bends his knees to a sitting position. To stand, the user may place his or her hands on handles 49, to raise himself or herself upwardly an incremental amount, and then move his/her hands in sequence (left, right, left, right, etc.) along handle sections 51 and finally to hand grip portion 35 to complete the standing maneuver. Handle section 51 has a greater angle to the floor than handle sections 49, 35.

Each leg portion 25, 27 may be telescopically extendable in order to lengthen leg portions 25, 27 so as to adjust the height of the walker with respect to the height of the user. Extending or shortening leg portions 25, 27 adjusts the height of hand grip portion 35 to a comfortable position.

As shown in FIG. 1, the front and rear leg portions of each frame 13, 15 are joined by a respective side crossbar 53, 55. Side crossbars 53, 55 are disposed parallel to the floor or horizontal.

The ends of crossbars 53, 55 are cut out in a radius for mating with the outside cylindrical surface of leg portions 25, 27. A press fit plug (not shown) may be placed in each end of a side crossbar 53, 55 to permit securement of the crossbars to the leg portions 23, 25. A bolt (not shown) passes through a respective side frame and into an axially threaded hole (not shown) in the plug of the side crossbar. Other securement means may be used including nuts and washers, welding, etc.

Referring again to FIG. 1, a pair of identical wrist guards 61, 63 are connected respectively to sides 13, 15. The wrist guards support the inside of the wrists when the user is gripping the hand grip portions.

Figure 4:
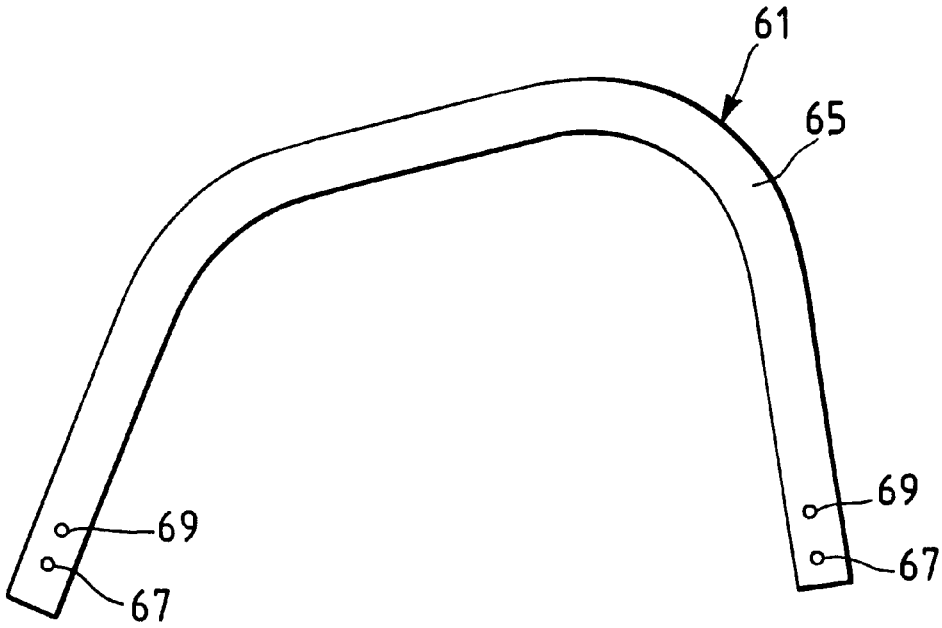
FIG. 4 is a side view of a wrist guard of the walker of FIG. 1.
Figure 5:
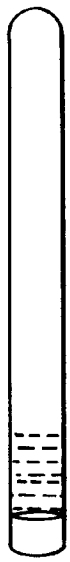
FIG. 5 is an end view of the wrist guard of FIG. 4.

As shown in FIG. 4, each wrist guard 61, 63 is preferably formed from a hollow light weight cylindrical tube 65 made of aluminum or other metal alloys or plastics, for example, and having an outside diameter equal to that of tube 23. Tube 65 is bent in the shape shown. Each wrist guard 61, 63 is generally planar lying within the planes defined by the outside and inside surfaces of tube 65, as shown in FIG. 5. Two sets of a pair of holes 67, 69 pass through each end of wrist guards 61, 63 for receiving bolts (not shown) to secure guards 61, 63 either to the inside or outside surface of frames 13, 15. Nuts and washers (not shown) may be used on the other side of the bolt. As will suggest itself, the two ends of the wrist guard may be flattened for a conforming fit against the cylindrical surface of the frame, in the area where guards 61, 63 contact the frame. During use, the wrist guards 61, 63 make contact with the interior portion of the user's wrists. This provides a greater stability for the user while he or she is using the walker. This may allow for a user with a relatively strong upper body (such as, for example, an athlete recovering from a lower body injury or paraplegic to support his or her entire body weight using just his or her hands and wrists.

Figure 6:
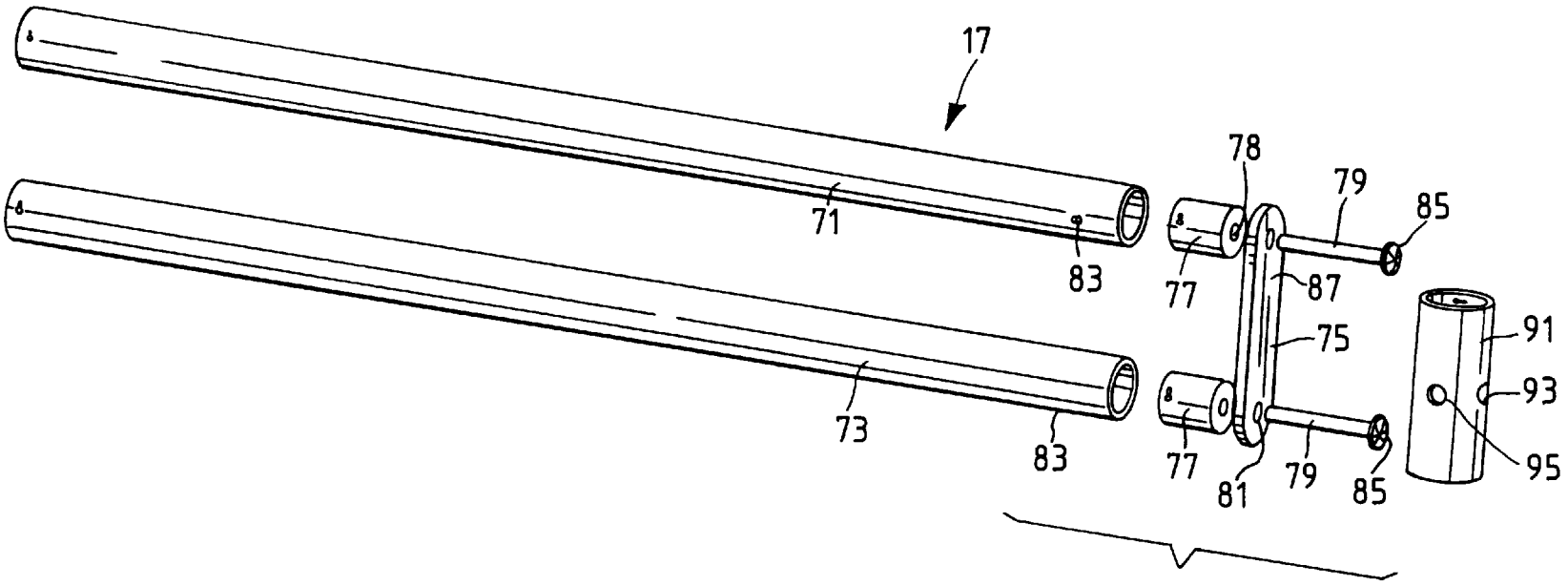
FIG. 6 is a perspective view of the rear crossbar of the walker of FIG. 1.

Referring to FIG. 6, rear crossbar 17 includes a pair of linear cylindrical tubes 71, 73 held in a parallel spaced apart relationship by a spacer plate 75 placed at the two lateral ends of the tubes. Each tube 71, 73 is 20.5 inches in length. A plug 77 is press fit into each of the four ends of the two tubes 71, 73. Each plug 77 has a threaded hole 78 for receiving a threaded bolt 79. A pair of spacer plates 75 (one shown) are secured to the ends of tubes 71, 73. Each one of four bolts 79 pass through a hole 81 in spacer plate 75 and into a plug 77. Holes 81 in spacer plate 75 are countersunk so that the heads 85 of bolts 71 lie flush with the top surface 87 of spacer plates 75. A hole 83 is bored in each end of tubes 71, 73 for receiving a screw (not shown) or the like to secure the plug 77 in position within tubes 71, 73.

A pair of cylindrical hinge tubes 91 (one shown in FIG. 6) is welded to each spacer plate 75. The axis of tube 91 is disposed parallel to the top surface 87 of plate 75 and in the plane defined by the axes of tubes 71, 73.

Hinge tube 91 is three inches in length and has an inner diameter of slightly larger than one inch so as to receive frame tube 23 in a rotatable or pivotal manner. The cylindrical hinge tubes 91 preferably have a slightly larger diameter than the diameter of legs 25, 27 such that a low friction sleeve (for example, a teflon plastic sleeve) (not shown) can be press fit between the tubes 91 and legs 25, 27. These sleeves are intended to allow vertical and pivotal movement of rear crossbar 17, as will be further discussed below. As shown in FIG. 1, hinge tube 91 is located on the linear rear leg portion of tube 23 of each side frame 13, 15. Left side frame 13 pivots or rotates within one hinge tube 91 allowing rotation of left side frame 13 relative to rear crossbar 17. Right side frame 15 pivots or rotates within the other hinge tube 91 allowing rotation of the right frame 15 relative to rear crossbar 17. Thus, one side frame may be pivoted independently of the other side frame.

Each hinge tube includes a pair of button holes 93, 95 5/16 inches in diameter. Button holes 93, 95 of left hinge tube 91 have their centers disposed at 87.2 degrees relative to each other. Button holes 93, 95 of right hinge tube 91 have their centers disposed at 92.8 degrees. A spring loaded button (not shown) may be mounted within tube 23 in a position for movement outwardly into button holes 93, 95 when the respective side frame is at a predetermined angle with respect to crossbar 17. This allows the side frames to be locked in a conventional walking position where the crossbar is substantially perpendicular to each side frame. The user may press the locking buttons inwardly to allow one or both of the frames to pivot. By adjusting the height of the crossbar, the user may avoid the locking buttons entering the button holes to allow both side frames to freely pivot. This allows for an articulated movement of the walker as the user moves in ordered steps one step following the next. As the user moves his or her left foot forward, he or she lifts and moves the left side frame 13 forward keeping his or her weight on the right frame 15 which is not moved. The rear crossbar 17 pivots on both frames 13, 15 as this first step is taken. The user then shifts his or her weight to the left frame 13 and moves his or her right foot forward. As the user moves his or her right foot forward, he or she lifts and moves the right side frame 15 forward keeping his or her weight on the left frame 13 which is not moved.

Referring again to FIG. 1, two pairs of cylindrical hinge vertical stops 97, 99, 101, 103 are disposed on rear leg portion 25, both above and below hinge tubes 91. Stops 97, 99, 101, 103 have an inside diameter of approximately one inch for freely receiving leg portion 25. A pair of threaded holes (not shown) pass through stops 97, 99, 101, 103, for receiving a threaded screw to secure the stops tightly to the frame in a desired position. This constrains the vertical position of crossbar 17.

The stops 97, 99 are preferably placed at a height which allows the crossbar 17 to clear the top of a toilet seat as the user backs the walker over the seat. Stops 101, 103 are preferably placed at a height which allows the crossbar 17 to be placed below the level of the seating portion of a chair, couch or bench. In this manner, the user may back into a seating position on a chair or the like without the rear crossbar 17 interfering with the user's legs.

In addition, the walker may be collapsed for storage. One side frame may be pivoted 90 degrees against the inside of crossbar 17. The other side frame may be pivoted 270 degrees against the outside of crossbar 17. Locking buttons and locking holes on hinge tube 91 may serve to lock the walker in its collapsed position.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

What is claimed is:

1. A walker, comprising:

a left side frame having a front support end and a rear support end, each of said ends being of a size for making supporting contact with a floor, said ends being spaced apart, said left side frame having a hand grip portion;

a right side frame having a front support end and a rear support end, each of said ends being of a size for making supporting contact with a floor, said ends being spaced apart, said right side frame having a hand grip portion; and a rear crossbar having a first pivot joint pivotally connecting said left frame member to said rear crossbar and a second pivot joint pivotally connecting said right frame member to said rear crossbar, wherein the first and second pivot joints permit both vertical and axial movement of the crossbar with respect to said left and right frame members.

2. A walker according to claim 1 wherein said hand grip portions include a grip surface that is inclined with respect to the horizontal.

3. A walker according to claim 2 wherein said left and right side frames include at least one further handhold located between said rear crossbar and said hand grip portion.

4. A walker according to claim 3 wherein said at least one further handhold includes a low pair of handholds, one of said low handholds located between said crossbar and said hand grip portion on said left side frame, and the other of said low handholds located between said crossbar and said hand grip portion of said right side frame.

5. A walker according to claim 4 wherein each of said low handholds has a first grip surface inclined with respect to the horizontal.

6. A walker according to claim 2 and further including a pair of wrist guards, each wrist guard including a surface disposed above said hand grip portion.

7. The walker of claim 1 wherein said walker has a base position wherein said left and right frame members are substantially parallel to one another and substantially perpendicular to said rear crossbar and wherein said first and second pivot joints permit one of said left and right frame members to rotate 90° with respect to said base position to form an abutting relationship with a front surface of said crossbar and said first and second pivot joints permit the other of said left and right frame members to rotate 270° with respect to said base position to form an abutting relationship with a rear surface of said crossbar.

8. A walker, comprising:

a left side frame having a front support end and a rear support end, each of said ends being of a size for making supporting contact with a floor, said ends being spaced apart, said left side frame having a hand grip portion;

a right side frame having a front support end and a rear support end, each of said ends being of a size for making supporting contact with a floor, said ends being spaced apart, said right side frame having a hand grip portion; and a pair of wrist guards, each wrist guard including a surface spaced above said hand grip portion, whereby when a user is gripping the hand grip portions the wrist guards support the wrists of the user.

9. The walker of claim 8 wherein said surfaces of said wrist guards are inclined with respect to the horizontal.

10. The walker of claim 9 wherein said wrist guard surfaces are disposed substantially parallel to said grip surfaces.

* * * * *